US009127531B2

(12) United States Patent
Maida et al.

(10) Patent No.: US 9,127,531 B2
(45) Date of Patent: Sep. 8, 2015

(54) OPTICAL CASING COLLAR LOCATOR SYSTEMS AND METHODS

(75) Inventors: John L. Maida, Houston, TX (US); Etienne M. Samson, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 697 days.

(21) Appl. No.: 13/226,578

(22) Filed: Sep. 7, 2011

(65) Prior Publication Data

US 2013/0056197 A1 Mar. 7, 2013

(51) Int. Cl.
*E21B 47/09* (2012.01)
*E21B 47/12* (2012.01)

(52) U.S. Cl.
CPC ..... *E21B 47/0905* (2013.01); *E21B 47/123* (2013.01)

(58) Field of Classification Search
CPC ..... E21B 47/00; E21B 47/09; E21B 47/0905; E21B 47/04; E21B 47/123; E21B 47/0006; E21B 47/12
USPC ..... 166/250.1, 254.2, 255.1, 65.1, 66.1
See application file for complete search history.

(56) References Cited

U.S. PATENT DOCUMENTS

| | | | | |
|---|---|---|---|---|
| 3,019,841 A | | 2/1962 | Ternow et al. | |
| 3,773,120 A | | 11/1973 | Stroud et al. | |
| 3,789,292 A | | 1/1974 | Bottoms | |
| 3,893,021 A | * | 7/1975 | Meador et al. | 324/341 |
| 3,980,881 A | * | 9/1976 | Veach et al. | 250/261 |
| 4,450,406 A | | 5/1984 | Bobb | |
| 4,785,247 A | | 11/1988 | Meador et al. | |
| 4,794,336 A | | 12/1988 | Marlow et al. | |
| 4,904,940 A | | 2/1990 | Rempt | |
| 4,933,640 A | | 6/1990 | Kuckes | |

(Continued)

FOREIGN PATENT DOCUMENTS

| | | |
|---|---|---|
| WO | WO-2011193401 | 2/2011 |
| WO | WO-2013/141971 | 9/2013 |
| WO | 2013/147996 | 10/2013 |

OTHER PUBLICATIONS

Halliburton Energy Services, Inc, "StimWatch Stimulation Monitoring Service—FiberWatch Fiber Optic Distributed Temperature Sensing Technology", Pinnacle, a Halliburton Services, http://www.halliburton.com/public/pe/contents/Data_Sheets/web/H/H04481.pdf, 2010, 4 pages., pp. 1-4.

(Continued)

*Primary Examiner* — Elizabeth Gitlin
(74) *Attorney, Agent, or Firm* — Krueger Iselin LLP

(57) ABSTRACT

Fiber optic enabled casing collar locator systems and methods including a wireline sonde or a coil tubing sonde apparatus configured to be conveyed through a casing string by a fiber optic cable. The sonde includes at least one permanent magnet producing a magnetic field that changes in response to passing a collar in the casing string. Such magnetic field changes induce voltages changes within associated pick-up electrical coil conductors. Some embodiments include a cylinder configured to change its diameter in response to the changes in the magnetic field and/or impressed voltage, and an optical fiber wound around the cylinder to convert the cylinder diameter change into an optical path length change for light being communicated along the fiber optic cable. The cylinder may include a magnetostrictive material or a piezoelectric material.

28 Claims, 4 Drawing Sheets

(56) References Cited

U.S. PATENT DOCUMENTS

| | | | | |
|---|---|---|---|---|
| 4,986,121 | A | 1/1991 | Luscombe | |
| 5,095,514 | A | 3/1992 | Curtis | |
| 5,204,619 | A | 4/1993 | Beigbeder et al. | |
| 5,429,190 | A | 7/1995 | Kilgore et al. | |
| 5,626,192 | A | 5/1997 | Connell et al. | |
| 5,675,674 | A * | 10/1997 | Weis | 385/12 |
| 5,712,828 | A | 1/1998 | Luscombe et al. | |
| 5,754,284 | A | 5/1998 | Leblanc et al. | |
| 5,786,915 | A | 7/1998 | Scobey | |
| 5,808,779 | A * | 9/1998 | Weis | 359/290 |
| 5,892,860 | A | 4/1999 | Maron et al. | |
| 5,898,517 | A * | 4/1999 | Weis | 356/5.09 |
| 5,943,293 | A | 8/1999 | Luscombe et al. | |
| 6,128,251 | A | 10/2000 | Erath et al. | |
| 6,137,621 | A * | 10/2000 | Wu | 359/290 |
| 6,160,762 | A | 12/2000 | Luscombe et al. | |
| 6,188,645 | B1 | 2/2001 | Maida et al. | |
| 6,188,646 | B1 | 2/2001 | Luscombe et al. | |
| 6,195,162 | B1 | 2/2001 | Varnham et al. | |
| 6,211,964 | B1 | 4/2001 | Luscombe et al. | |
| 6,233,746 | B1 | 5/2001 | Skinner | |
| 6,256,588 | B1 | 7/2001 | Maida et al. | |
| 6,268,911 | B1 | 7/2001 | Tubel et al. | |
| 6,307,809 | B1 | 10/2001 | Luscombe et al. | |
| 6,408,943 | B1 | 6/2002 | Schultz et al. | |
| 6,422,084 | B1 | 7/2002 | Fernald et al. | |
| 6,522,797 | B1 | 2/2003 | Siems et al. | |
| 6,591,025 | B1 | 7/2003 | Siems et al. | |
| 6,731,389 | B2 | 5/2004 | Luscombe et al. | |
| 6,789,621 | B2 | 9/2004 | Wetzel et al. | |
| 6,834,233 | B2 | 12/2004 | Economides et al. | |
| 6,847,034 | B2 | 1/2005 | Shah et al. | |
| 6,853,604 | B2 | 2/2005 | Spackman et al. | |
| 6,896,056 | B2 | 5/2005 | Mendez et al. | |
| 6,913,083 | B2 | 7/2005 | Smith | |
| 6,931,188 | B2 | 8/2005 | Kersey et al. | |
| 6,957,574 | B2 | 10/2005 | Ogle | |
| 7,006,918 | B2 | 2/2006 | Economides et al. | |
| 7,077,200 | B1 * | 7/2006 | Adnan et al. | 166/250.01 |
| 7,104,324 | B2 | 9/2006 | Wetzel et al. | |
| 7,133,582 | B1 * | 11/2006 | Moslehi et al. | 385/13 |
| 7,140,435 | B2 * | 11/2006 | Defretin et al. | 166/255.1 |
| 7,159,468 | B2 | 1/2007 | Skinner et al. | |
| 7,163,055 | B2 | 1/2007 | Coon et al. | |
| 7,182,134 | B2 | 2/2007 | Wetzel et al. | |
| 7,195,033 | B2 | 3/2007 | Mayeu et al. | |
| 7,219,729 | B2 | 5/2007 | Bostick, III et al. | |
| 7,219,730 | B2 | 5/2007 | Tilton et al. | |
| 7,245,791 | B2 | 7/2007 | Rambow et al. | |
| 7,408,645 | B2 | 8/2008 | DiFoggio | |
| 7,409,858 | B2 | 8/2008 | Dria et al. | |
| 7,413,011 | B1 | 8/2008 | Chee et al. | |
| 7,458,273 | B2 | 12/2008 | Skinner et al. | |
| 7,511,823 | B2 | 3/2009 | Schultz et al. | |
| 7,529,434 | B2 | 5/2009 | Taverner et al. | |
| 7,617,873 | B2 | 11/2009 | Lovell et al. | |
| 7,665,543 | B2 | 2/2010 | Bostick, III et al. | |
| 7,669,440 | B2 | 3/2010 | Kersey et al. | |
| 7,900,699 | B2 * | 3/2011 | Ramos et al. | 166/250.01 |
| 8,035,393 | B2 * | 10/2011 | Tenghamn et al. | 324/365 |
| 8,074,713 | B2 * | 12/2011 | Ramos et al. | 166/255.1 |
| 8,135,541 | B2 | 3/2012 | Davis et al. | |
| 8,274,400 | B2 | 9/2012 | Wilson et al. | |
| 2003/0127232 | A1 * | 7/2003 | Bussear et al. | 166/373 |
| 2003/0205375 | A1 | 11/2003 | Wright et al. | |
| 2003/0210403 | A1 | 11/2003 | Luscombe et al. | |
| 2004/0165809 | A1 | 8/2004 | Kersey et al. | |
| 2005/0072678 | A1 | 4/2005 | Hunter et al. | |
| 2005/0247082 | A1 | 11/2005 | Kersey et al. | |
| 2005/0271107 | A1 | 12/2005 | Murakami et al. | |
| 2006/0081412 | A1 | 4/2006 | Wright et al. | |
| 2006/0157239 | A1 * | 7/2006 | Ramos et al. | 166/254.2 |
| 2007/0107573 | A1 | 5/2007 | Weusthof et al. | |
| 2007/0126594 | A1 * | 6/2007 | Atkinson et al. | 340/853.1 |
| 2007/0194948 | A1 | 8/2007 | Hall et al. | |
| 2009/0058422 | A1 * | 3/2009 | Tenghamn et al. | 324/337 |
| 2009/0120640 | A1 | 5/2009 | Kulakofsky et al. | |
| 2009/0271115 | A1 | 10/2009 | Davis et al. | |
| 2010/0158435 | A1 | 6/2010 | Kersey et al. | |
| 2010/0309750 | A1 | 12/2010 | Brady | |
| 2011/0084696 | A1 * | 4/2011 | Tenghamn et al. | 324/337 |
| 2011/0090496 | A1 | 4/2011 | Samson et al. | |
| 2011/0116099 | A1 | 5/2011 | Spross et al. | |
| 2011/0139447 | A1 * | 6/2011 | Ramos et al. | 166/254.2 |
| 2012/0013482 | A1 | 1/2012 | Patel et al. | |
| 2012/0013893 | A1 | 1/2012 | Maida et al. | |
| 2012/0250017 | A1 * | 10/2012 | Morys et al. | 356/335 |
| 2013/0056202 | A1 | 3/2013 | Maida et al. | |
| 2013/0249705 | A1 | 9/2013 | Sharp et al. | |

OTHER PUBLICATIONS

Ravi, Kris et al., "Cement Slurry Monitoring", U.S. Appl. No. 13/028,542, filed Feb. 16, 2011, 19 pgs.

Shell, Baker Hughes, "Pioneer Real-time Compaction Imaging System", Oil&Gas Eurasia, http://www.oilandgaseurasia.com/news/p/2/news/5146, Jun. 29, 2009, 2 pgs.

"International Search Report and Written Opinion", dated Nov. 27, 2012, Appl No. PCT/US2012/054284, "Optical Casing Collar Locator Systems and Methods", filed Sep. 7, 2012, 21 pgs.

"PCT Internat'l Search Report and Written Opinion", dated Sep. 29, 2009, Appl No. PCT/US2009/053492, A Near-Field Electromagnetic Communications Network for Downhole Telemetry, filed Aug. 11, 2009, 7 pgs.

"PCT International Preliminary Report on Patentability", dated Jun. 27, 2013, Appl No. PCT/US2012/054284, "Optical Casing Collar Locator Systems and Methods", filed Sep. 7, 2012, 5 pgs.

"PCT International Search Report and Written Opinion", Dated Nov. 18, 2013, Appl No. PCT/US2013/024852, "Optical Casing Collar Locator Systems and Methods," filed Feb. 6, 2013, 9 pgs.

"PCT International Search Report and Written Opinion", Dated Nov. 18, 2013 Appl No. PCT/US2013/024849, "Casing Collar Locator with Wireless Telemetry Support," filed Feb. 6, 2013, 9 pgs.

"US Final Office Action", dated Sep. 27, 2012, U.S. Appl. No. 13/432,206, "Optical Casing Collar Locator Systems and Methods", filed Sep. 7, 2011, 11 pgs.

"US Non-Final Office Action", dated May 29, 2012, U.S. Appl. No. 13/432,206, "Optical Casing Collar Locator Systems and Methods", filed Sep. 7, 2011, 14 pgs.

"U.S. Non-Final Office Action", dated Sep. 5, 2013, U.S. Appl. No. 13/432,206, "Optical Casing Collar Locator Systems and Methods", filed Mar. 28, 2012, 11 pgs.

Li, Weizhuo et al., "Wavelength Multiplexing of Microelectromechanical System Pressure and Temperature Sensors Using Fiber Bragg Gratings and Arrayed Waveguide Gratings", Opt. Eng. Society of Photo-Optical Instrumentation Engineers, 0091-3286/2003, (Feb. 2003), pp. 431-438.

MacDougall, Trevor W., et al., "Large Diameter Waveguide Bragg Grating Components and Their Application in Downhole Oil & Gas Sensing", Weatherford International, Wallingford, CT, 12 pgs.

IPRP, dated Apr. 15, 2014, Appl No. PCT/US2013/24849, "Casing Collar Locator with Wireless Telemetry Support," filed Feb. 6, 2013.

IPRP, dated Apr. 15, 2014, Appl No. PCT/US2013/24852, "Optical Casing Collar Locator Systems and Methods," Filed Feb. 6, 2013.

US Final Office Action, dated Mar. 26, 2014, U.S. Appl. No. 13/432,206, "Optical Casing Collar Locator Systems and Methods", filed Mar. 28, 2012.

US Non-Final Office Action, dated Sep. 29, 2014, U.S. Appl. No. 13/426,414, "Casing Collar Locator with Wireless Telemetry Support," filed Mar. 21, 2012.

* cited by examiner

OPTICAL CASING COLLAR LOCATOR SYSTEMS AND METHODS

BACKGROUND

After a wellbore has been drilled, the wellbore typically is cased by inserting lengths of steel pipe ("casing sections") connected end-to-end into the wellbore. Threaded exterior rings called couplings or collars are typically used to connect adjacent ends of the casing sections at casing joints. The result is a "casing string" including casing sections and connecting collars that extends from the surface to a bottom of the wellbore. The casing string is then cemented in place to complete the casing operation.

After a wellbore is cased, the casing is often perforated to provide access to a desired formation, e.g., to enable formation fluids to enter the well bore. Such perforating operations require the ability to position a tool at a particular and known position in the well. One method for determining the position of the perforating tool is to count the number of collars that the tool passes as it is lowered into the wellbore. As the length of each of the steel casing sections of the casing string is known, correctly counting a number of collars or joints traversed by a device as the device is lowered into a well enables an accurate determination of a depth or location of the tool in the well. Such counting can be accomplished with a casing collar locator ("CCL"), an instrument that may be attached to the perforating tool and suspended in the wellbore with a wireline.

A wireline is an armored cable having one or more electrical conductors to facilitate the transfer of power and communications signals between the surface electronics and the downhole tools. Such cables can be tens of thousands of feet long and subject to extraneous electrical noise interference and crosstalk. In certain applications, the detection signals from conventional casing collar locators may not be reliably communicated via the wireline.

BRIEF DESCRIPTION OF THE DRAWINGS

A better understanding of the various disclosed embodiments can be obtained when the detailed description is considered in conjunction with the attached drawings, in which.

Figure 1:
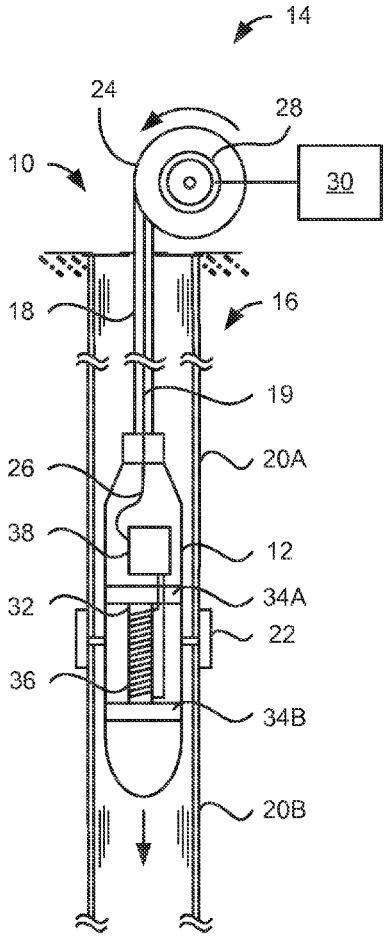
FIG. 1 is a side elevation view of a well having a casing collar locator (CCL) system in accordance with certain illustrative embodiments.

While the invention is susceptible to various alternative forms, equivalents, and modifications, specific embodiments thereof are shown by way of example in the drawings and will herein be described in detail. It should be understood, however, that the drawings and detailed description thereto do not limit the disclosure, but on the contrary, they provide the foundation for alternative forms, equivalents, and modifications falling within the scope of the appended claims.

DETAILED DESCRIPTION

The problems outlined above are at least in part addressed by casing collar locator (CCL) systems and methods that provide optical detection signals. In at least some embodiments, the casing collar locator system includes a sonde configured to be conveyed through a casing string by a fiber optic cable. The sonde includes at least one permanent magnet producing a magnetic field that changes in response to a passing casing collar. Some sonde embodiments further include a cylinder configured to change its diameter in response to the changes in the magnetic field, and an optical fiber wound around the cylinder to convert the cylinder diameter change into an optical path length change for light being communicated along the fiber optic cable. Other disclosed sonde embodiments include a source or a switch or a microbender configured to change the amplitude or intensity of the light communicated along the fiber optic cable in response to changes in the permanent magnet's field.

Turning now to the figures, FIG. 1 is a side elevation view of a well 10 in which a sonde 12 of a casing collar locator system 14 is suspended in a casing string 16 of the well 10 by a fiber optic cable 18. The casing string 16 includes multiple tubular casing sections 20 connected end-to-end via collars. FIG. 1 specifically shows two adjacent casing sections 20A and 20B connected by a collar 22. As is typical, the casing sections 20 of the casing string 16 and the collars connecting the casing sections 20 (e.g., the collar 22) are made of steel, an iron alloy. We note here that the steel is a ferromagnetic material with a relatively high magnetic permeability and a relatively low magnetic reluctance, so it conveys magnetic lines of force much more readily than air and certain other materials.

In the embodiment of FIG. 1, the fiber optic cable 18 includes at least one optical fiber 19 and preferably also includes armor to add mechanical strength and/or to protect the cable from shearing and abrasion. Additional optical fibers and/or electrical conductors may be included if desired. Such additional fibers can, if desired, be used for power transmission, communication with other tools, and redundancy. The fiber optic cable 18 spools to or from a winch 24 as the sonde 12 is conveyed through the casing string 16. The reserve portion of the fiber optic cable 18 is wound around a drum of the winch 24, and the fiber optic cable 18 is dispensed or unspooled from the drum as the sonde 12 is lowered into the casing string 16.

In the illustrated embodiment, the winch 24 includes an optical slip ring 28 that enables the drum of the winch 24 to rotate while making an optical connection between the optical fiber 19 and a fixed port of the slip ring 28. A surface unit 30 is connected to the port of the slip ring 28 to send and/or receive optical signals via the optical fiber 19. In other embodiments, the winch 24 includes a electrical slip ring 28 to send and/or receive electrical signals from the surface unit 30 and an electro-optical interface that translates the signals from the optical fiber for communication via the slip ring and vice versa.

The sonde 12 includes an optical fiber 26 coupled to the optical fiber 19 of the fiber optic cable 18. The surface unit 30 receives signals from the sonde 12 via the optical fibers 19 and 26, and in at least some embodiments transmits signals to the sonde via the optical fibers 19 and 26. When the sonde 12 passes a collar in the casing string 16 (e.g. the collar 22), the sonde communicates this event to the surface unit 30 via the optical fibers 19 and 26.

In the embodiment of FIG. 1, the sonde 12 also includes a permanent magnet 32, two pole pieces 34A and 34B, a coil 36, and a signal transformer 38 positioned in a protective housing. The permanent magnet 32 has opposed north and south poles aligned along a central axis of the sonde 12. The coil 36 is a length of insulated wire wound around the permanent magnet 32 and having two ends connected to the signal transformer 38. The signal transformer 38 is coupled to the optical fiber 26, and communicates with the surface unit 30 via the optical fiber 26 of the sonde 12 and the optical fiber 19 of the fiber optic cable 18.

In the embodiment of FIG. 1, the permanent magnet 32 has a north pole adjacent the pole piece 34A and a south pole adjacent the pole piece 34B, and produces a magnetic field extending outwardly from the north pole and returning to the south pole. The disk-shaped pole pieces 34A and 34B are made of a ferromagnetic material with a relatively high magnetic permeability and a relatively low magnetic reluctance, such as ferrite. Having a low magnetic reluctance, the pole piece 34A directs most of the magnetic field produced by the permanent magnet 32 radially outward from the sonde 12 and toward the casing string 16. The pole piece 34B directs most of the magnetic field radially inward from the casing string 16 toward the sonde 12. The housing of the sonde 12 is preferably formed of a nonmagnetic material such as aluminum, brass, or fiberglass that does not impede the magnetic field produced by the permanent magnet 32.

The permanent magnet 32, the pole pieces 34A and 34B, and the walls of the casing string 16 between the pole pieces 34A and 34B form a magnetic circuit through which most of the magnetic field produced by the permanent magnet 32 passes. The total magnetic field intensity passing through the magnetic circuit depends on the sum of the magnetic reluctance of each element in the circuit. The magnetic reluctance of the casing string wall depends on the thickness of the casing wall, which changes significantly in the presence of a casing collar.

The coil 36 wound around the permanent magnet 32 is subject to Faraday's law: any change in the strength of the magnetic field passing through the coil 36 will cause an electrical voltage to be induced between the ends of the coil 36. Magnetic field strength is symbolized with the letter 'B' which stands for flux density. The magnitude of the induced voltage is proportional to the rate of change of the strength of the magnetic field with respect to time (dB/dt), the cross sectional area of the coil 36, and the number of turns of wire in the coil 36.

When the sonde 12 is passing through one of the casing sections 20 of the casing string 16, the wall thickness is constant, meaning that the strength of the magnetic field passing through the coil 36 does not change, and no voltage is induced between the ends of the coil 36. On the other hand, when the sonde 12 passes a collar in the casing string 16 (e.g. the collar 22), the wall thickness changes, causing the strength of the magnetic field passing through the coil 36 to change, which induces a voltage between the ends of the coil 36. The signal transformer 38 receives the voltage produced by the coil 36, and responsively communicates with the surface unit 30 via the optical fiber 26 (and the optical fiber 19 of the fiber optic cable 18).

Figure 2:
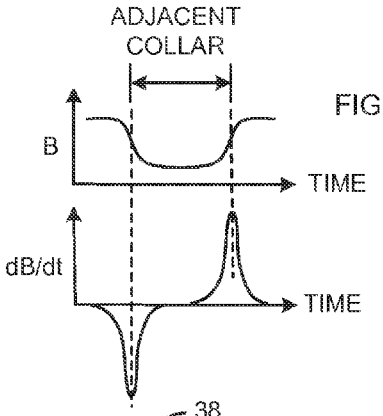
FIG. 2 includes a pair of explanatory graphs illustrating a detection of a casing collar.

FIG. 2 includes a pair of graphs indicating changes that occur when the sonde 12 of FIG. 1 passes a collar in the casing string 16 (e.g. the collar 22). A first graph shows the magnetic field strength 'B' in the coil 36 versus time as the sonde 12 passes a collar, and the second graph shows the rate of change of the strength of the magnetic field with respect to time (dB/dt) in the coil 36 versus time as the sonde 12 passes the collar. The transitions between a nominal field strength and the field strength in the proximity of the collar appear as a positive and negative voltage peaks between the ends of the coil 36. Signal transformer 38 can convert one or both of these voltage peaks to an optical signal for communication to the surface unit 30.

Figure 3:
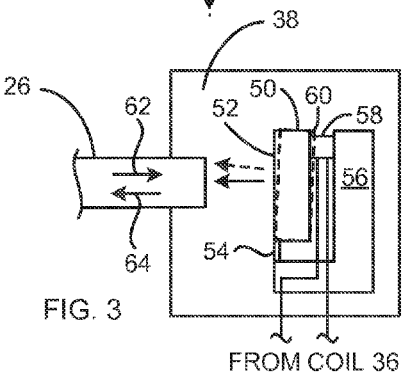
FIGS. 3-5 show different illustrative signal transformer embodiments.

Signal transformer 38 can take a variety of forms. FIG. 3 is a diagram of one illustrative embodiment which includes a mirror element 50 adapted to move in response to the voltage signal from the coil 36 such that an amount of light reflected along optical fiber 26 to the surface unit 30 (FIG. 1) changes when the sonde 12 of FIG. 1 passes a collar in the casing string 16 (e.g. the collar 22). The mirror element 50 includes a reflective surface 52 that reflects light. A hinge element 54 attaches the mirror element 50 to a base 56 at one edge of the mirror element 50. A mechanism 58 is coupled between a backside surface 60 of the mirror element 50, opposite the reflective surface 52, and the base 56. The mechanism 58 receives the voltage signal from the coil 36, and rotates the mirror element 50 about the hinge element 54 dependent upon the voltage signal from the coil 36.

The signal transformer embodiment of FIG. 3 may be used when the surface unit 30 (FIG. 1) includes a light source. The optical fiber 19 of the fiber optic cable 18 and the optical fiber 26 convey light generated by the surface unit 30 to the signal transformer 38 as source light 62. The source light 62 is incident on the reflective surface 52. The mechanism 58 rotates the mirror element 50 about the hinge element 54 dependent upon the voltage signal from the coil 36 such that an amount of light reflected from the reflective surface 52 and entering the optical fiber 26 as reflected light 64 changes when the sonde 12 passes a collar in the casing string 16 (e.g. the collar 22). In some embodiments, the mechanism 58 rotates the mirror element 50 such that and the amount of light reflected from the reflective surface 52 and entering the optical fiber 26 as reflected light 64 increases when the sonde 12 passes a collar. In other embodiments, the amount of light reflected from the reflective surface 52 and entering the optical fiber 26 as reflected light 64 decreases when the sonde 12 passes a collar.

Components of the signal transformer 38, such as the mirror element 50, the hinge element 54, the mechanism 58, and the base 56, are preferably formed on or from a monolithic substrate such as in a microelectromechanical system (MEMS). Such miniature apparatus are hundreds of times smaller and lighter than typical conventional apparatus. This may be advantageous in that the signal transformer 38 can be made less susceptible to mechanical shocks generated during deployment of the sonde 12 in the casing string 16. For example, a monolithic silicon substrate may form the base 56. The mirror element 50 may be a cantilever structure etched or machined from the silicon substrate, where the hinge element 54 is the remaining silicon that connects the cantilever mirror element 50 to the silicon substrate. A reflecting layer may be deposited on an outer surface of the cantilever mirror element 50, forming the reflective surface 52.

The mechanism 58 may employ electrical attraction and repulsion to rotate the cantilever mirror element 50 about the hinge element 54 dependent upon the voltage signal from the coil 36. A first conductive layer may be deposited or otherwise formed on the backside surface 60 of the cantilever mirror element 50. A second conductive layer may be deposited or otherwise formed on a surface of the silicon substrate adjacent the first conductive layer. The voltage signal from the coil 36 may be applied to the first and second conductive layers such that electrical repulsion between the first and second conductive layers causes the cantilever mirror element 50 to rotate about the hinge element 54 in a direction away from the substrate. Conversely, the cantilever mirror element can be caused to rotate toward the substrate if the conductive layers are driven at opposite polarities to provide electrical attraction.

An alternative mechanism 58 may employ a piezoelectric element to rotate the cantilever mirror element 50 in response to the voltage signal from the coil 36. If the mirror is biased so that a zero voltage signal corresponds to a maximum reflected light intensity, the negative voltage peak and the positive voltage peak each cause a rotation of the mirror element to reduce the reflected light intensity, thereby indicating the passing of a casing collar.

Figure 4:
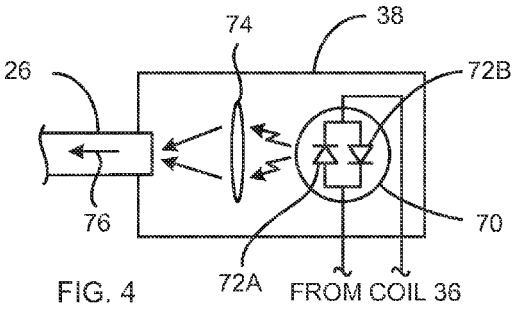

FIG. 4 is a diagram of another illustrative embodiment of the signal transformer 38. In the embodiment of FIG. 4, the signal transformer 38 includes a light source 70 coupled to the ends of the coil 36 and producing light when a voltage exists between ends of the coil 36. The light source 70 includes a pair of light emitting diodes (LEDs) 72A and 72B in an antiparallel arrangement. Other suitable light sources include, without limitation, semiconductor diode lasers, superluminescent diodes, and incandescent lamps. The signal transformer 38 also includes a lens 74 that directs at least some of the light produced by the light source 70 into an end of the optical fiber 26 positioned in the signal transformer 38. One of the LEDs (e.g., 72A) is energized by a positive voltage peak, whereas the other is energized by a negative voltage peak. As the sonde 12 moves past a casing collar, first one LED then the other sends a light pulse along the optical fiber to the surface unit 30. This signal transformer embodiment may be advantageous in that it does not require surface unit 30 to have a light source to provide an optical signal from the surface.

Figure 5:
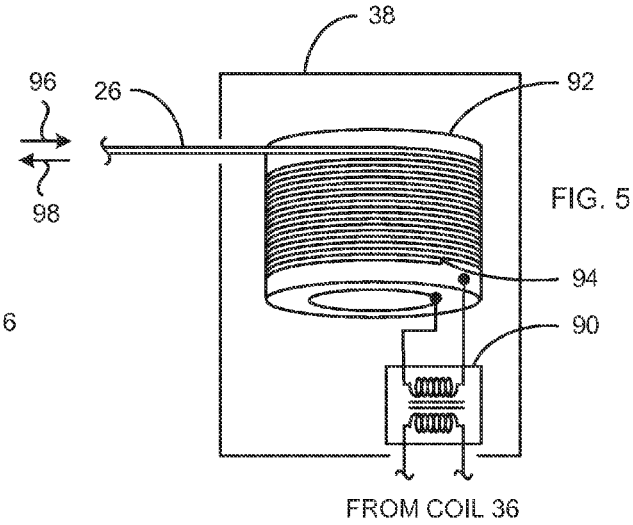

FIG. 5 shows yet another illustrative embodiment of the signal transformer 38. In the embodiment of FIG. 5, the signal transformer 38 includes an (optional) impedance matching transformer 90 coupled between the coil 36 and the drive electrodes of a cylinder 92 of piezoelectric material. The impedance matching transformer 90 provides an efficient way to scale the output voltage of coil 36 to match the drive requirements for the piezoelectric cylinder, and may further scale the equivalent impedance of the piezoelectric cylinder to match that of the coil 36 to facilitate an efficient energy transfer.

The piezoelectric cylinder 92 is a hollow cylinder with an inner surface electrode and an outer surface electrode. The piezoelectric material is a substance that exhibits the reverse piezoelectric effect: the internal generation of a mechanical force resulting from an applied electrical field. Suitable piezoelectric materials include lead zirconate titanate (PZT), lead titanate, and lead metaniobate. For example, lead zirconate titanate crystals will change by about 0.1% of their static dimension when an electric field is applied to the material. The piezoelectric cylinder 92 is configured such that a diameter of the outer surface of the piezoelectric cylinder 92 changes when an electrical voltage is applied between the inner and outer surfaces. As a result, the diameter of the outer surface of the piezoelectric cylinder 92 is dependent on the electrical voltage produced by the coil 36.

In the embodiment of FIG. 5, a terminal portion of the optical fiber 26, including an end or terminus 94 of the optical fiber 26, is wound around the outer surface of the piezoelectric cylinder 92. The terminal portion of the optical fiber 26 is tightly wound around the outer surface of the piezoelectric cylinder 92 such that the terminal portion of the optical fiber 26 is under some initial mechanical stress. The terminus 94 is preferably attached to the outer surface of the piezoelectric cylinder 92, and may or may not have a mirrored coating or layer to reflect light (i.e., a mirrored terminus). Even in the absence of a mirrored coating, the terminus 94 may be expected to reflect a significant fraction of the incident light due to an index of refraction mismatch with the air. As the cylinder's diameter expands or contracts, so too does the cylinder's circumference, thereby stretching the length of the terminal portion of the optical fiber 26 accordingly. Any stretching of the optical fiber also increases the mechanical stress being imposed on the fiber. These two effects combine to increase the optical path length for any light traveling to or from the terminus 94.

The illustrated signal transformer may be used when the surface unit 30 (FIG. 1) includes a light source that transmits a continuous or pulsed light signal along the optical fiber 19, and further includes a receiver that measures the phase changes or time delays in the light reflected from the terminus 94. Such measurements (which are discussed further below with reference to FIG. 9) represent the optical path length changes that are indicative of passing casing collars.

Figure 6:
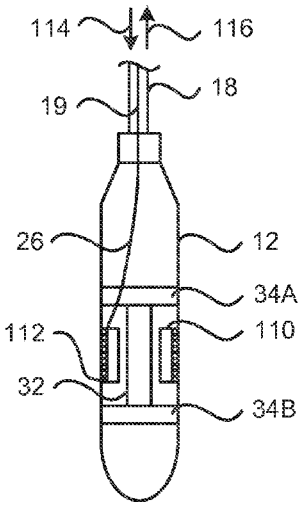
FIG. 6 is a diagram of an alternative CCL sonde embodiment.

A similar result can be achieved by forming a cylinder of magnetostrictive material rather than piezoelectric material. FIG. 6 is a diagram of a sonde embodiment that employs a magnetostrictive cylinder 110. (Elements shown in FIG. 1 and described above are labeled similarly in FIG. 6.) The magnetostrictive cylinder 110 is a hollow cylinder positioned about the permanent magnet 32 such that the magnetostrictive cylinder 110 and the permanent magnet 32 are coaxial, and the magnetostrictive cylinder 110 is midway between the pole pieces 34A and 34B. The magnetostrictive material exhibits a change in dimensions when a magnetic field is applied. Suitable magnetostrictive materials include cobalt, Terfenol-D, and $Fe_{81}Si_{3.5}B_{13.5}C_2$ (trade name METGLAS 2605SC). The magnetostrictive cylinder 110 is configured such that a diameter of the outer surface of the magnetostrictive cylinder 110 changes when an applied magnetic field changes. As a result, the diameter of the outer surface of the magnetostrictive cylinder 110 is dependent on the portion of the magnetic field generated by the permanent magnet 32 and applied to the magnetostrictive cylinder 110.

In the embodiment of FIG. 6, a terminal portion of the optical fiber 26, including an end or terminus 112 of the optical fiber 26, is wound around the outer surface of the magnetostrictive cylinder 110 as shown in FIG. 6. The terminal portion of the optical fiber 26 is tightly wound around the outer surface of the magnetostrictive cylinder 110 such that the terminal portion of the optical fiber 26 is under some initial mechanical stress. The terminus 112 is preferably attached to the outer surface of the magnetostrictive cylinder 110, and may or may not have a mirrored coating or layer to reflect light (i.e., a mirrored terminus). The terminal portion of the optical fiber 26 may also be in contact with an inner surface of the housing of the sonde 12 such that the optical fiber 26 experiences additional mechanical stress (due to being pinched between the housing and the cylinder) when the magnetostrictive cylinder 110 expands.

The embodiment of FIG. 6 may be used in conjunction with a surface unit 30 that includes a light source, and the optical fiber 19 of the fiber optic cable 18 conveys the light generated by the surface unit 30 to the coiled terminal portion of optical fiber 26 source light 114. When the source light 114 traveling in the optical fiber 26 reaches the terminus 112, a portion of the light is reflected at the terminus 112 as reflected light 116. The reflected light 116 is conveyed by the optical fiber 19 of the fiber optic cable 18 and the optical fiber 26, and is received by the surface unit 30.

In some embodiments, the surface unit 30 generates the source light 114 as pulses of light, and measures a time between generation of a pulse of the source light 114 and reception of a corresponding pulse of the reflected light 116. In other embodiments, the surface unit 30 generates a monochromatic and continuous source light 114, and measures a phase difference between the source light 114 and the reflected light 116.

When the sonde 12 of FIG. 1 is passing through one of the casing sections 20 of the casing string 16, the strength of the magnetic field passing through the magnetostrictive cylinder 110 does not change, nor does the length of an optical path traveled by the source light 114 and the reflected light 116 in the optical fiber 26. A time between generated pulses of the source light 114 and corresponding received pulses of the reflected light 116 does not change, nor does a difference in phase between generated monochromatic and continuous source light 114 and received reflected light 116.

When the sonde 12 of FIG. 1 approaches a collar in the casing string 16 (e.g. the collar 22), the strength of the magnetic field passing through the magnetostrictive cylinder 110 decreases. As a result, the outer diameter of the magnetostrictive cylinder 110 changes, as does the length of the optical path traveled by the source light 114 and the reflected light 116 in the optical fiber 26. Consequently, the time between generated pulses of the source light 114 and corresponding received pulses of the reflected light 116 changes, as does the difference in phase between generated monochromatic and continuous source light 114 and received reflected light 116.

When the sonde 12 of FIG. 1 moves past the collar in the casing string 16 (e.g. the collar 22), the strength of the magnetic field passing through the magnetostrictive cylinder 110 increases. As a result, the outer diameter of the magnetostrictive cylinder 110 again changes, as does the length of the optical path traveled by the source light 114 and the reflected light 116 in the optical fiber 26. Consequently, the time between generated pulses of the source light 114 and corresponding received pulses of the reflected light 116 changes, as does the difference in phase between generated monochromatic and continuous source light 114 and received reflected light 116.

Figure 7:
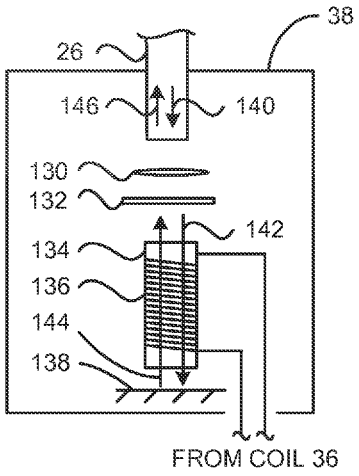
FIGS. 7-8 show more illustrative signal transformer embodiments.

Returning to the illustrative sonde configuration of FIG. 1, other signal transformer configurations are also contemplated. FIG. 7 is a diagram of another illustrative embodiment. In the embodiment of FIG. 7, the signal transformer 38 includes a lens 130, a polarizer 132, a magneto-optical element 134, a coil 136, and a reflective surface 138. For this signal transformer, the system employs a surface unit 30 having a light source, and the optical fiber 19 of the fiber optic cable 18 and the optical fiber 26 convey light generated by the surface unit 30 to the signal transformer 38 as source light 140. The lens 130 collimates the source light 140 from fiber 26 to move substantially parallel to an optical axis. A polarizer 132 is positioned on the optical axis to substantially block all components of the source light 140 except those in a selected plane of polarization (e.g., "horizontally" polarized light). The resulting polarized light 142 exits the polarizer 132 and enters the magneto-optical element 134.

A coil of insulated wire 136 is wound around the magneto-optical element 134 and having two ends connected to the ends of the coil 36 of FIG. 1. When a voltage is generated in the coil 36, electrical current flows through the coil 136, producing a magnetic field in and around the coil 136 that passes through the magneto-optical element 134. This field is hereafter referred to as the "sensing" field to distinguish it from a static biasing field provided by an arrangement of permanent magnets. The sensing field is a transient response to a passing casing collar, whereas the biasing field remains static during the tool's operation. Both fields are oriented parallel to the optical axis.

The magneto-optical element 134 is formed from magneto-optical material that is substantially transparent to the polarized light 142, with the caveat that it rotates the plane of polarization of the polarized light 142 by an amount proportional to the magnetic field along the optical axis. Note that this rotation is not dependent on the light's direction of travel, meaning that as the reflected light 144 propagates back through the magneto-optical material, the plane of polarization is rotated still further in accordance with the strength of the magnetic field. Suitable magneto-optical materials for accomplishing this effect include yttrium iron garnet (YIG) crystals, terbium gallium garnet (TGG) crystals, or terbium-doped glasses (including borosilicate glass and dense flint glass).

The dimensions of the magneto-optical element and the biasing field strength are chosen so that, in the absence of a sensing field, the light polarization goes through a 45° rotation in one pass through the magneto-optical element, for a total rotation of 90° in a two-way trip. Since the polarizer 132 only passes the selected plane of polarization (e.g., horizontal), it blocks the reflected light 144 in the absence of a sensing field. When the sensing field is not zero (e.g., when the sonde is passing a casing collar), the sensing field causes the polarization to rotate by an additional angle of, say, $\alpha$. A two-way traversal of the magneto-optical element in the presence of a sensing field causes the polarization to rotate by $2\alpha+90°$, enabling some light to pass through the polarizer. The intensity of the passing light is proportional to $\sin^2 2\alpha$, where $\alpha$ is proportional to the sensing field. It is expected that this configuration may advantageously provide a very high sensitivity together with a high immunity to mechanical shock.

Figure 8:
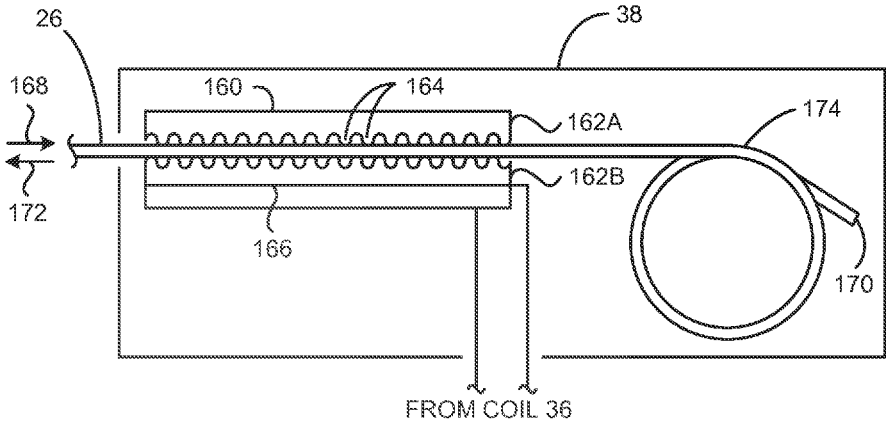

FIG. 8 is a diagram of yet another illustrative embodiment of the signal transformer 38, which exploits a light-leakage characteristic of optical fibers. Optical fibers typically include a transparent core surrounded by a transparent cladding material having a lower index of refraction, so that light propagating fairly parallel to the fiber's axis is trapped in the core by the phenomenon of total internal reflection. If bent too sharply, however, the angle between the light's propagation path and the cladding interface is no longer sufficient to maintain total internal reflection, enabling some portion of the light to escape from the fiber.

This light leakage characteristic can be exploited with a microbend sensor or microbender 160 such as that shown in FIG. 8. The microbender 160 includes a pair of opposed ridged elements 162A and 162B, each having a row of ridges 164 in contact with an outer surface of the optical fiber 26. The optical fiber 26 is positioned in a gap between the ridged elements 162A and 162B. The teeth 164 of the ridged elements 162A and 162B are aligned so as to intermesh. In other words, ridges on one element align with valleys in the other element and vice versa. A force or pressure that urges the ridged elements 162A and 162B toward one another causes small bends or "microbends" in the optical fiber 26 at multiple locations along the optical fiber 26. As a result, light propagating along the optical fiber 26 is attenuated by an amount dependent upon the force or pressure that urges the ridged elements 162A and 162B toward one another.

In the embodiment of FIG. 8, the ridged element 162B is mounted on a piezoelectric substrate 166 that exhibits a change in dimensions when an electric field is applied between its upper and lower surfaces. The leads from coil 36 apply a rectified voltage signal to the upper and lower surfaces of the piezoelectric substrate 166, causing the gap to briefly close in response to the passing of a casing collar. Alternatively, the substrate 166 may be a magnetostrictive material surrounded by a coil that induces a magnetic field in response to a voltage signal from coil 36.

For signal transformers employing a microbender, the surface unit 30 (FIG. 1) includes a light source, and the optical fiber 19 of the fiber optic cable 18 and the optical fiber 26 convey light generated by the surface unit 30 to the signal transformer 38 as source light 168. When the source light 114 traveling in the optical fiber 26 reaches an end or terminus 170 of the optical fiber 26, a portion of the light is reflected at the terminus 170 as reflected light 172. The reflected light 172 is conveyed by the optical fiber 26 and the optical fiber 19 of the fiber optic cable 18, and the intensity of the reflected light may be monitored by the surface unit 30 as a measure of the signal being detected by coil 36. The terminus 170 may or may not have a reflective layer or coating (i.e., a mirrored terminus).

Alternatively, the surface unit 30 may include a optical time domain reflectometer (OTDR) system that generates the source light 168 as pulses of light, and monitors the light scattered back to the surface from imperfections along the length of the fiber. The time required for scattered light to reach the receiver is directly proportional to the position along the fiber where the scattering occurred. Thus the OTDR system sees scattered light from increasingly distant positions as a function of time after the light pulse is transmitted. The increasing distance causes the intensity of the scattered light to show a gentle decrease due to attenuation in the fiber. Though not the subject of the present application, the characteristics of the scattered light can be monitored to provide distributed sensing of temperature and/or pressure along the length of the fiber.

A microbender, however, will create a sudden change in the scattered light intensity and the scattered light from more distant positions in the fiber will be severely attenuated. The OTDR system can readily measure this attenuation to monitor the voltage signal from coil 36, provided that the optical fiber 26 is provided with a "pigtail" 174 between the microbender 160 and the terminus 170. A length of the pigtail 174 is preferably greater than half a minimum distance resolution of the OTDR system of the surface unit 30. For example, if a minimum distance resolution of the OTDR system is 3.3 feet (1.0 meter), the length of the pigtail 174 is preferably greater than 1.6 feet (0.5 meter). A selected minimum length of the pigtail 174 may be, for example, 3.3 feet (1.0 meter), but greater lengths are easily employed.

When the sonde 12 passes along one of the casing sections 20, the strength of the magnetic field passing through the coil 36 is expectedly substantially constant, and the rate of change of the strength of the magnetic field passing through the coil 36 with respect to time (dB/dt) is expectedly 0. As a result, when a pulse of the source light 168 is generated, the scattered light follows a baseline curve as a function of position along the fiber, and the intensity the reflected light 172 is expectedly at a relative maximum value. However, as a casing collar passes, the magnetic field passing through coil 36 exhibits sharp changes, causing peaks in the voltage signal from the coil. The microbender gap shrinks, causing attenuation of the light passing therein. The scattered light observable by an OTDR system will have a substantial deviation from the baseline curve, and the intensity of any light reflected from the fiber terminus will be greatly reduced.

Figure 9:
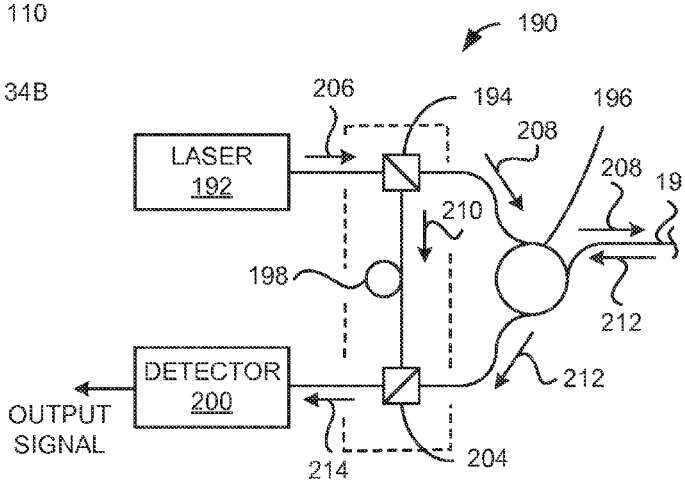
FIG. 9 is a diagram of an illustrative detection system.

FIG. 9 shows an illustrative embodiment of a source/receiver configuration 190 that may be employed by the surface unit 30. The illustrative configuration 190 includes a laser light source 192, a beam splitter 194, an optical circulator 196, a reference path 198, a detector 200, and a beam combiner 204. The laser light source 192 produces a continuous beam of laser light as a source beam 206. The beam splitter 194 splits the source beam 206 into a measurement beam 208 and a reference beam 210 such that the measurement beam 208 and the reference beam 210 each have about half the intensity of the source beam 206. The measurement beam 208 is transmitted along the optical fiber 19 by an optical circulator 196, while the reference beam 210 follows the reference path 198 (e.g., a selected length of optical fiber).

In the signal transformer embodiments of FIGS. 5 and 6, the light transmitted along the optical fiber is subjected to a phase change in accordance with the presence or absence of a casing collar, and reflected back along the optical fiber 29 as reflected beam 212. The optical circulator 196 directs the reflected beam 212 beam to beam combiner 204. The beam combiner 204 combines the reflected beam 212 with the reference beam 210 to provide a resultant beam 214 to detector 200. As the two components of the resultant beam are coherent, they undergo constructive or destructive interference depending on their difference in phase. As the phase difference changes, the detector 200 observes intensity oscillations between a maximum and minimum value, each complete oscillation corresponding to one "interference fringe". The occurrence of a large number of interference fringes in a short amount of time is indicative of a passing casing collar. The variety of suitable interferometer configurations includes Michelson, Mach-Zehender, Fabry-Perot, and Sagnac.

Some source/receiver configurations omit the reference arm (beam splitter 194, reference path 198, and beam combiner 204). For example, in systems that employ a signal transformer such as one of those shown in FIGS. 3, 7, and 8, the casing collar location information is conveyed by the intensity of the reflected signal rather than by its phase. The detector directly monitors the reflected signal intensity rather than employing an interferometer configuration. In some system embodiments (e.g., in those employing a signal transformer embodiment similar to FIG. 4), the surface unit 30 does not require a light source at all, as the light is generated downhole.

Figure 10:
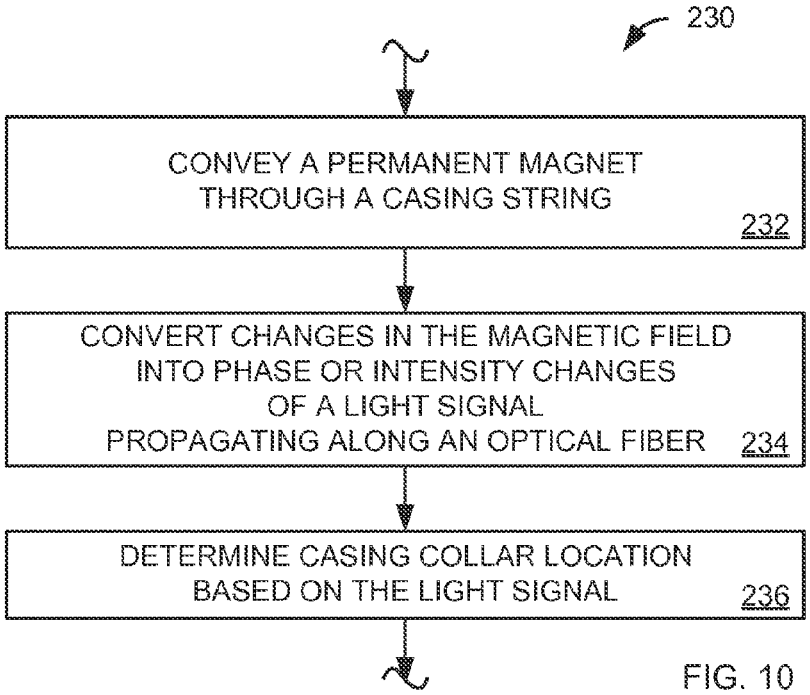
FIG. 10 is a flowchart of a casing collar locator method.

FIG. 10 is a flowchart of an illustrative casing collar locator method 230 that may be carried out by the casing collar locator system 14. As represented by block 232, the method includes conveying a permanent magnet (e.g., the permanent magnet 32 of FIGS. 1 and 6) through a casing string. The length of the wireline cable may be monitored as the sonde is lowered into or pulled out of the casing string.

The method further includes converting changes in the field from the magnet into phase or intensity changes of a light signal that propagates along an optical fiber to the surface, as represented by block 234. In at least some embodiments, the conversion includes changing an optical path length traversed by the light signal by expanding or contracting a cylinder around which the optical fiber is wound. The cylinder can include a piezoelectric or magnetostrictive material to produce this effect. In other embodiments, the conversion includes altering an attenuation of the light propagating through a microbender, through a magneto-optical element, or reflecting off of a mirror, based on a voltage signal from a wire coil around the magnet. Still other embodiments include generating the light signal downhole directly from the voltage signal.

The phase or intensity information in the light signal is then monitored to determine the location of casing collars relative to the tool, as represented by block 236. The current wireline length from block 232 may be stored as a tentative casing collar location when the presence of a casing collar is detected in this block.

Numerous variations and modifications will become apparent to those skilled in the art once the above disclosure is fully appreciated. The foregoing description discloses a wireline embodiment for explanatory purposes, but the principles are equally applicable to, e.g., a tubing-conveyed sonde with an optical fiber providing communications between the sonde and the surface. It is intended that the following claims be interpreted to embrace all such variations and modifications.

What is claimed is:

1. A casing collar locator system that comprises:

a sonde configured to be conveyed through a casing string, wherein the sonde comprises:

at least one permanent magnet producing a magnetic field that changes in response to passing a collar in the casing string;

a coil that receives at least a portion of the magnetic field and provides an electrical signal in response to said changes in the magnetic field;

a piezoelectric cylinder configured to change its diameter in response to the electrical signal;

an impedance matching transformer that couples the coil to the piezoelectric cylinder; and an optical fiber wound around the piezoelectric cylinder to convert the cylinder diameter change into an optical path length change for light being communicated along a fiber optic cable linking the sonde to a surface unit.

2. The system of claim 1, wherein the optical fiber has a mirrored terminus.

3. The system of claim 1, wherein the optical fiber has one terminus configured to receive source light from the fiber optic cable and an opposite terminus configured to deliver return light to the fiber optic cable.

4. The system of claim 1, wherein the coil comprises a length of insulated wire wound around the permanent magnet and having two ends, wherein the electrical signal is produced between the ends of the wire.

5. The system of claim 1, wherein the cylinder is hollow with opposed inner and outer surfaces, and wherein the electrical signal produced by the coil causes the impedance matching transformer to produce a second electrical signal that is coupled between the inner and outer surfaces.

6. The system of claim 1, wherein the surface unit comprises:

a light source;

a beam splitter coupled between the light source and the fiber optic cable to generate two light beams, at least one of which is communicated along the fiber optic cable; and a detector that measures an interfering combination of the two light beams.

7. The system of claim 6, wherein collar locations are associated with the detection of interference fringes.

8. A casing collar locator system that comprises:

a sonde configured to be conveyed through a casing string, wherein the sonde comprises:

at least one permanent magnet producing a magnetic field that changes in response to passing a collar in the casing string;

an optical fiber having light leakage that varies in accordance with its bend radius; and a microbender configured to change the bend radius of the optical fiber in response to said changes in the magnetic field, wherein modulated light from the microbender is attenuated by the microbender in accordance with a rate of the changes in the magnetic field; and a surface unit coupled to the sonde by a fiber optic cable to receive modulated light from the microbender.

9. The system of claim 8, wherein the optical fiber has a mirrored terminus.

10. The system of claim 8, wherein the optical fiber has one terminus configured to receive source light from the fiber optic cable and an opposite terminus configured to deliver return light to the fiber optic cable.

11. The system of claim 8, wherein the microbender has a gap between surfaces having valleys aligned with peaks, the optical fiber passing through the gap and bending in accordance with a gap width.

12. The system of claim 11, wherein the microbender includes a magnetostrictive element that varies the gap width in response to the rate of said changes in the magnetic field.

13. The system of claim 8, wherein the sonde further comprises a coil that receives at least a portion of the magnetic field and provides an electrical signal in response to said changes in the magnetic field.

14. The system of claim 13, wherein the coil comprises a length of insulated wire wound around the permanent magnet and having two ends, wherein the electrical signal is produced between the ends of the wire.

15. The system of claim 13, wherein the microbender includes a piezoelectric element that varies the gap width in response to said electrical signal.

16. The system of claim 8, wherein the surface unit comprises an optical time domain reflectometer (OTDR) that measures scatter light from distributed locations along the length of an optical path that includes the fiber optic cable and the optical fiber.

17. The system of claim 16, wherein the optical fiber includes a pigtail after the microbender, the pigtail having a length of not less than one meter.

18. A casing collar locator method that comprises:

conveying a permanent magnet through a casing string; and converting changes in a field from said magnet into phase changes of light propagating along an optical fiber coiled around a piezoelectric cylinder, said converting including employing a wire coil to transform said changes into an electrical signal and applying said electrical signal to said piezoelectric cylinder through an impedance matching transformer.

19. The method of claim 18, wherein said converting includes positioning said wire coil in the field from said magnet.

20. A casing collar locator method that comprises:

conveying a permanent magnet through a casing string; and adjusting a microbender gap in response to changes in a field from said magnet, thereby varying an attenuation of light passing along an optical fiber coupled to the microbender, said attenuation being in accordance with the rate of the changes in said field.

21. The method of claim 20, wherein said adjusting includes positioning the microbender in the field from said magnet, wherein the microbender includes a magnetostrictive element that changes dimension in response to the rate of said changes in the field.

22. The method of claim 20, wherein said adjusting includes employing a wire coil to transform said changes into an electrical signal and applying the electrical signal to a piezoelectric component of the microbender.

23. A casing collar locator system that comprises:

a sonde configured to be conveyed through a casing string, wherein the sonde comprises:

at least one permanent magnet producing a magnetic field that changes in response to passing a collar in the casing string;

a coil that receives at least a portion of the magnetic field and provides an electrical signal in response to said changes in the magnetic field;

a light source that is powered by said electrical signal to communicate light along an optical fiber to indicate passing collars; and a surface unit that detects a time between pulses of light received via the optical fiber to determine a position of the sonde.

24. The system of claim 23, wherein the light source comprises at least one of: an incandescent lamp, an arc lamp, an LED, a semiconductor laser, and a superluminescent diode.

25. A casing collar locator system that comprises:

a sonde configured to be conveyed through a casing string, wherein the sonde comprises:

at least one permanent magnet producing a magnetic field that changes in response to passing a collar in the casing string;

a magnetostrictive cylinder configured to change its diameter in response to said changes in the magnetic field; and an optical fiber wound around the magnetostrictive cylinder to convert the cylinder diameter change into an optical path length change for light being communicated along a fiber optic cable linking the sonde to a surface unit, wherein the optical fiber has a mirrored terminus.

26. The system of claim 25, wherein the optical fiber has one terminus configured to receive source light from the fiber optic cable and an opposite terminus configured to deliver return light to the fiber optic cable.

27. The system of claim 25, wherein the surface unit comprises:

a light source;

a beam splitter coupled between the light source and the fiber optic cable to generate two light beams, at least one of which is communicated along the fiber optic cable; and a detector that measures an interfering combination of the two light beams.

28. The system of claim 27, wherein collar locations are associated with the detection of interference fringes.

* * * * *